US008070164B1

(12) United States Patent
Gaehring

(10) Patent No.: US 8,070,164 B1
(45) Date of Patent: Dec. 6, 2011

(54) METHOD OF PLAYING A CHILD'S MEMORY GAME

(76) Inventor: Alice Gaehring, Southampton, NJ (US)

( * ) Notice: Subject to any disclaimer, the term of this patent is extended or adjusted under 35 U.S.C. 154(b) by 4 days.

(21) Appl. No.: 12/927,743

(22) Filed: Nov. 23, 2010

(51) Int. Cl.
*A63F 1/00* (2006.01)

(52) U.S. Cl. ..... 273/273

(58) Field of Classification Search ..... 273/273, 273/292
See application file for complete search history.

(56) References Cited

U.S. PATENT DOCUMENTS 1,420,400 A * 6/1922 Ayre ..... 273/273
5,405,148 A * 4/1995 Cianci ..... 273/273
5,887,872 A * 3/1999 Keifer et al. ..... 273/273
5,921,549 A * 7/1999 Wilson et al. ..... 273/292
2007/0007725 A1* 1/2007 Matilla et al. ..... 273/236

OTHER PUBLICATIONS

Farm 3-D Memory Match-Up, http://boardgamegeek.com/boardgame/35749/farm-3-d-memory-match-up, Mar. 2011.*

* cited by examiner

*Primary Examiner* — William M Pierce
(74) *Attorney, Agent, or Firm* — Stuart M. Goldstein

(57) ABSTRACT

A child's memory game utilizes a plurality of miniature chairs and smaller play pieces. The play pieces all depict characters related to a particular subject, e.g. breakfast food. The chairs are lined up with their backs facing the players. One character play piece is placed on each chair, out of sight of the players. The players alternate guessing the location of play pieces and are awarded the chairs and play pieces when they guess correctly. The player with the most chairs and play pieces is the winner.

3 Claims, 3 Drawing Sheets

METHOD OF PLAYING A CHILD'S MEMORY GAME

BACKGROUND OF THE INVENTION

Memory development is a significant objective of a child's learning process. This process is often difficult, especially for younger children, given that they usually have short attention spans and sometimes are not receptive to learning. As a result, memory games have been and are used to enhance a child's thinking and concentration. To be effective, however, such games must be enjoyable and entertaining, while still being educational.

SUMMARY OF THE INVENTION

It is thus the object of the present invention to provide a child's memory game which is simple and fun to play, yet challenges the memory of the child.

This object is accomplished by the present invention, a child's memory game which utilizes a plurality of miniature chairs and smaller play pieces. The play pieces all depict characters related to a particular subject, e.g. breakfast food. The chairs are lined up with their backs facing the players. One character play piece is placed on each chair, out of sight of the players. The players alternate guessing the location of play pieces and are awarded the chairs and play pieces when they guess correctly. The player with the most chairs and play pieces is the winner.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
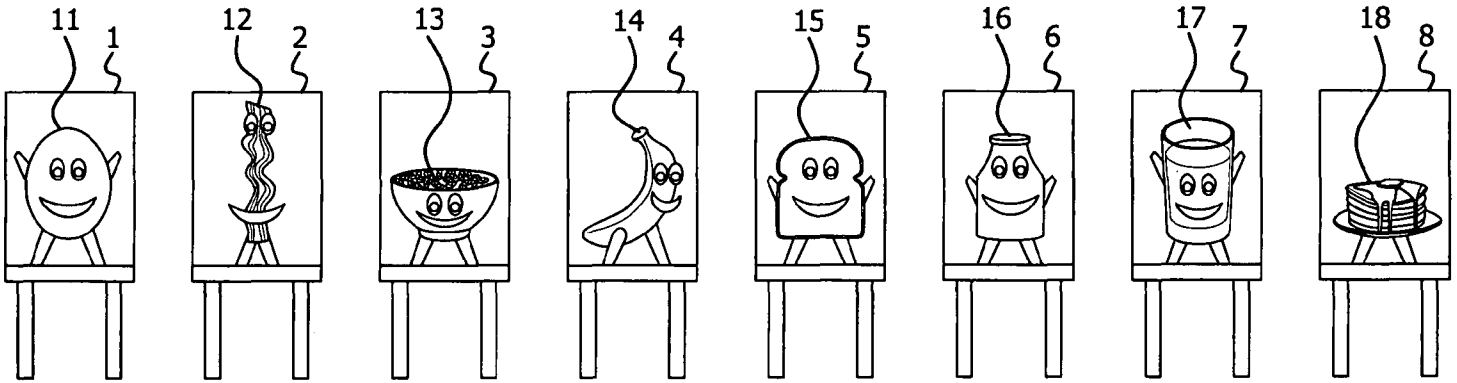
FIG. 1 is a front view of the chairs and play pieces, set-up for playing the memory game of the present invention.

The child's memory game of the present invention comprises miniature character components or play pieces representing items in the category which is the subject of the game. Utilizing breakfast as an example, the following character components formed as life-like items, are to be provided as play pieces: egg 11, bacon 12, cereal 13, banana 14, toast 15, milk 16, juice 17 and pancakes 18.

Figure 2:
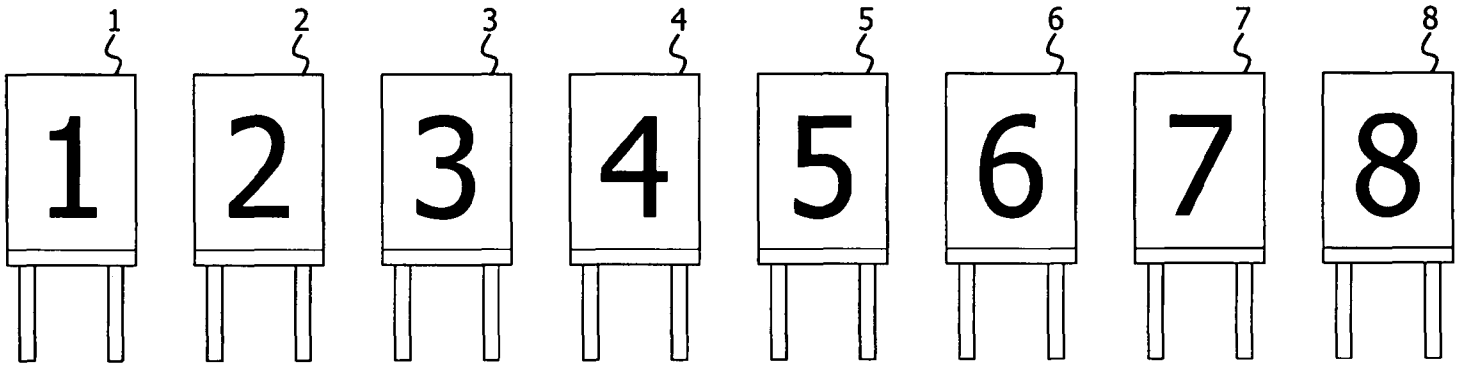
FIG. 2 is a rear view of the chairs set-up for playing the memory game of the present invention.
Figure 3:
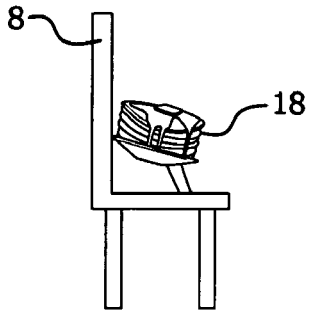
FIG. 3 is an elevation view of one of the chairs and a play piece set-up for playing the memory game of the present invention.
Figure 4:
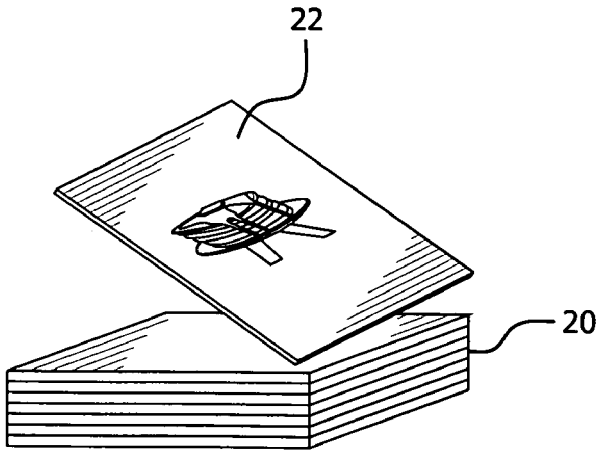
FIG. 4 is a view of the cards utilized for playing the memory game of the present invention.

Each of these play pieces is configured to be located or "seated" in miniature chairs; in this case eight chairs 1-8 are provided. The backs of each of the chairs are so numbered, as seen in FIG. 2. The respective dimensions of the play pieces and the chairs are such that when the play piece is seated in the chair, it cannot be seen when the chair is observed from behind. A representative height of a chair would be 8 inches, with each play piece being 4 to 6 inches in height.

A deck of cards 20 is provided, each card having a picture of one of the play pieces. In the above example, there would be eight cards. Card 22 has a picture of the pancake play piece 18. The names of the play pieces can also be on the cards, providing a reading tool for the child players.

Figure 5:
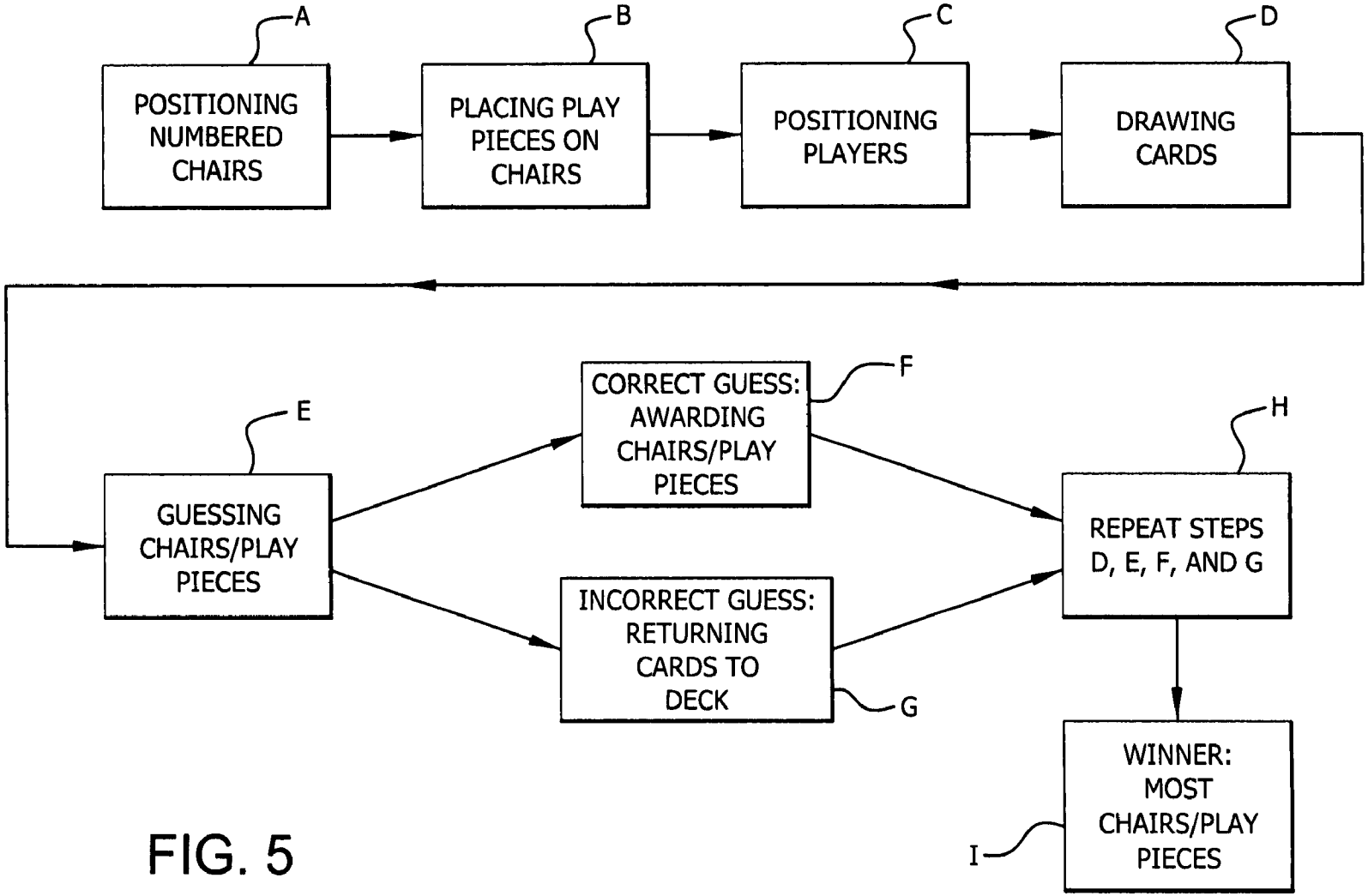
FIG. 5 is a flow chart depicting the steps of the claimed method.

The steps of the method of the game are depicted in the FIG. 5 flow chart, Steps A-1 indicating the primary steps of the claimed method. The game begins by the placement of chairs 1-8 adjacent to each other, in a line-up parallel to the edge of a table, or similar level surface. The chairs are positioned with their backs facing the table's edge, so only the backs with their numbers are visible to anyone located behind the edge. See FIG. 2 and FIG. 5, Step A. A non-player faces the front of the chairs 1-8 and places play pieces 11-18 on the chairs. FIG. 5, Step B. With the non-player maintaining his or her position facing chairs 1-8 and play pieces 11-18, players position themselves behind the table's edge, so that they can only see the backs of the chairs and their numbers. FIG. 5, Step C.

The first player draws a card from deck 20. FIG. 5, Step D. That player must then guess the numbered chair on which the play piece which corresponds to the play piece shown on the drawn card is located. FIG. 5, Step E. If the player is correct, the non-player awards that chair and play piece to the player and the card is discarded. FIG. 5, Step F. If the player is incorrect, the chair, with the seated play piece, is returned by the non-player to its original place in the chair line-up and the card is returned to the bottom of deck 20. FIG. 5, Step G.

The second player next picks a card from deck 20 and the process is repeated, i.e. the player must guess the numbered chair on which the play piece which corresponds to the play piece shown on the drawn card is located. FIG. 5, Step H. This guess is made with the knowledge of the play piece located on the previously selected chair, since the play piece on that chair has already been revealed. If the second player remembers this placement, he or she will use this knowledge to select a different chair. Once again, if the player is correct, the non-player awards that chair and play piece to the player and the card is discarded. If the player is incorrect, the chair, with seated play piece, is returned by the non-player to its original place in the chair line-up and the card is returned to the bottom of the deck. FIG. 5, Step H.

The process is again repeated, with each player taking alternate turns in guessing the location of the play piece shown on the drawn card. FIG. 5, Step H. The winner is the player with the most chairs and play pieces. FIG. 5, Step I.

The memory game of the present invention can be played with one or more players, utilizing any number of chairs and play pieces. The description of the game employing eight chairs and play pieces is for illustrative purposes only. Similarly, the subject matter of the play pieces is not restricted to breakfast characters, but can represent any number of different categories, e.g. sports, cartoons, literary characters, etc.

As an additional bonus, the play pieces can be used by a child independently of the chairs. They can be enjoyed simply as toys, with which the child can play.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A method of playing a memory game with one or more players comprising the steps of:

providing a plurality of miniature chairs having seats and backs;

numbering the backs of the chairs sequentially;

positioning the chairs adjacent to each other in line-up configuration;

providing a plurality of miniature play pieces, each play piece having a height less than the then the height of the back of the chairs;

placing one play piece on each of the seats of the chairs;

positioning one or more players behind the line-up of chairs, out of sight of the play pieces;

providing a deck of cards, the deck comprising as many cards as play pieces and each card having a picture of one of the play pieces;

drawing a card from the deck;

guessing on which chair the play piece shown on the drawn card is located;

revealing the play piece on the guessed chair;

awarding the chair and play piece to the player who correctly guesses the location of the play piece;

maintaining the chair and play piece in the line-up when a player incorrectly guesses the location of the play piece;

repeating the drawing, guessing, revealing, awarding, and maintaining steps until all the chairs and play pieces have been awarded;

determining the winner by the number of chairs and play pieces each player has been awarded.

2. The method of playing a memory game as in claim 1 further comprising the steps of returning a drawn card to the bottom of the deck after an incorrect guess and discarding a drawn card after a correct guess.

3. The method of playing a memory game as in claim 1 wherein the play pieces all depict characters which are related to a particular subject.

* * * * *